US005924837A

United States Patent [19]

Passmann

[11] Patent Number: 5,924,837

[45] Date of Patent: Jul. 20, 1999

[54] EXTENSIBLE TELESCOPIC MACHINE PART

[75] Inventor: Christoph Passmann, Dortmund, Germany

[73] Assignee: Spitznas Maschinenfabrik GmbH, Velbert, Germany

[21] Appl. No.: 08/827,586

[22] Filed: Mar. 28, 1997

[30] Foreign Application Priority Data

Mar. 29, 1996 [DE] Germany ..... 196 13 700

[51] Int. Cl.[6] ..... B66C 23/00

[52] U.S. Cl. ..... 414/718; 414/918

[58] Field of Search ..... 414/718, 728, 414/918; 212/349; 52/115, 118

[56] References Cited

U.S. PATENT DOCUMENTS

| | | | |
|---|---|---|---|
| 3,777,629 | 12/1973 | Johnston et al. | 414/718 X |
| 3,836,025 | 9/1974 | Olson et al. | 414/118 X |
| 4,034,875 | 7/1977 | Pugh et al. | 212/349 X |
| 4,129,277 | 12/1978 | Tenniswood . | |
| 4,255,076 | 3/1981 | Svenning | 414/718 X |
| 4,406,375 | 9/1983 | Hockensmith | 212/349 |
| 4,470,229 | 9/1984 | Muse et al. | 414/918 X |
| 4,809,472 | 3/1989 | Hade, Jr. et al. . | |
| 4,954,041 | 9/1990 | Dahlquist et al. | 414/718 |
| 5,494,397 | 2/1996 | Wilson | 414/728 |

FOREIGN PATENT DOCUMENTS

| | | |
|---|---|---|
| 2721636 A1 | 5/1977 | Germany . |
| 3214147 | 4/1982 | Germany . |
| 3508604 A1 | 3/1985 | Germany . |

*Primary Examiner*—Donald W. Underwood
*Attorney, Agent, or Firm*—McDermott, Will & Emery

[57] ABSTRACT

An extensible telescopic machine part such as a telescopic boom for an excavator has three extensible, telescopic elements. One of the telescopic elements carries a working unit at its free end remote from the other telescopic elements. The working unit is supplied with energy through flexible energy transmission lines. Actuators for causing telecopic relative movement of the telescopic elements are provided. The energy transmission lines extend inside the machine part and are arranged in a carrier track. The actuators are arranged off axis with respect to the telescopic elements to provide space for the carrier track. The carrier track extends from a forward end of the outer telescopic element to the rear end of the inner telescopic element, The carrier track is guided between the outer and median telescopic elements and forms a bight around the rear end of the inner telescopic element.

8 Claims, 2 Drawing Sheets

EXTENSIBLE TELESCOPIC MACHINE PART

TECHNICAL FIELD

The invention relates to an extensible, telescopic machine part comprising at least two telescopic elements, one of these elements carrying a working unit at its free end, remote from the other element, the working unit being supplied with energy through at least one flexible energy transmission line or conduit, and further comprising actuators for extending and retracting the telescopic elements.

Such extensible, telescopic machine parts may, for example, be telescopic booms of excavators or of cranes. The working unit may, for example, be a grab. The working unit may, for example, be actuated electrically or hydraulically, the energy transmission lines then being either electrical cables or hydraulic hose pipes. The actuators for telescopic movement of the elements may, for example, be hydraulic jacks and/or cable actuators.

In particular, the invention relates to the arrangement and guiding of the energy transmission lines from a source of energy to the working unit, the source of energy, in general, being located outside the machine part in the machine itself. This involves considerable difficulties, as the energy transmission lines have to follow the movements of the extensible, telescopic machine part without the risk of damage.

BACKGROUND ART

There are guite a few different solutions of the problem of guiding the energy transmission lines in such telescopic machine parts. A simple solution consists in providing flexible lines or hose pipes on the outside of the telescopic boom. The lines or hose pipes are long enough to permit maximum extension of the telescopic boom. When the telescopic boom is retracted, the lines or hose pipes form uncontrollable, depending bights, whereby the risk of damage of the lines or hose pipes is high.

In order to avoid such damages, German patent application 3,214,147 suggests a telescopic boom, wherein the flexible energy transmission line or hose pipe is arranged in a chain, which is flexible in one direction only, namely about transverse axes. By means of stops or cams, the chain is prevented from flection about the transverse axes opposite this direction. This chain extends between a point at the outer end of a base section of the boom and a point at a telescopic section. With retracted boom, the chain extends between the wall of the base section and the wall of the telescopic section and forms a c-shaped bight outside the boom. With extended boom, the chain extends along the telescopic section on the outside thereof. Because of the design of the chain, the chain cannot sag to a substantial extent, whereby the risk of damage of the energy transmission lines or hose pipes, for example due to being caught, is reduced.

Guiding the energy transmission lines or hose pipes on the outside of the boom is, however, disadvantageous, even if sagging of the lines or hose pipes is prevented. The guiding device and the lines or hose pipes are subjected to contaminations and influences due to weather, which can considerably affect their useful life.

German patent application 3,508,604 discloses a telescopic boom with a system for feeding a liquid under pressure through conduits from one end of the telescopic boom to the other end, wherein the conduit system extends inside the telescopic boom. The telescopic boom consists of three tubular elements of circular cross sections. The three tubular elements are movable relative to each other. An outer tube surrounds a median tube which, in turn, surrounds an inner tube. A hydraulically operated working unit is attached to the free end of the inner tube. One or more hydraulic conduits extend from a hydraulic source to a connecting socket, which is attached to the end of the outer tube. Hydraulic hose pipes extend from the connecting socket through the annulus between the outer tube and the median tube around a deflection roller and further to a hose coupling on the underside of the inner tube. From this hose coupling, a conduit extends to a hydraulically operated unit at the outer end of the inner tube. The deflection roller is attached to the inner end of the median tube. With respect to their relative movements, the telescopic tubes are forcedly controlled such that, when the median tube is moved into the outer tube or out of the outer tube, the deflection roller is axially moved and maintains the hydraulic hose pipes orderly straight, if the hose coupling moves inwards or outwards at twice the speed of the axial movement of the deflection roller. In order to obtain sufficient space for the conduits between the outer tube and the median tube, the median tube may be slightly eccentric with respect to the outer tube.

It has been found that the use of deflection rollers in the guiding device for such energy transmission lines not only generates undesirable strain but also causes wear of the conduits. Furthermore, the design is rather complex and expensive. In particular if hydraulic hose pipes are used as energy transmission lines, these disadvantages are considerable. As a rule, the hydraulic hose pipes are very long (10 meters and more). If they are exposed to pressure, there will be a considerable change of the length of the hose pipes, which may be 20 centimeters or more. Due to this change of length, the hose pipes may slacken and run off the deflecting rollers. High pre-tension of the hose pipes is required, if this is to be prevented.

German patent application 2,721,636 discloses a device in loading devices with extensible, telescopic booms. The boom has at least one telescopic arm, which is displaceable by a hydraulic jack and piston rod out of a box carrier. The hydraulic jack is attached to the displaceable arm. The piston rod extends to the rear from this arm and is attached to the rear end of the box carrier. Load carrying means are provided at the outer end of the telescopic arm. The load carrying means are operable by hydraulic actuators. Similar to the present invention, also German patent application 2,721,636 deals with the placement of hydraulic hose pipes from the boom to the hydraulic actuators of the load carrying means. In order to permit maximum extension of the arm relative to the boom, part of the hydraulic hose pipe forms a loop with a c-shaped bight. This c-shaped bight extends to the rear longitudinally of the boom and of the arm, and is accommodated in a space limited by the walls of the arm and of the boom. Thereby, the hydraulic hose pipes are located inside the boom and are protected from outside influences. The hydraulic jack and the piston rod are arranged centrally in the boom. Thereby little space is provided for the hydraulic hose pipes inside the boom, in particular for the c-shaped hose pipe bight. If a plurality of hydraulic hose pipes are provided, this has the consequence that some hose pipe bights have to be arranged on one side of the piston rod, while the other ones have to be arranged on the other side of the piston rod. In order to prevent wear of the hose pipes freely extending in the boom, the walls of the boom are provided with a smooth surface.

Also, this design and guiding of the energy transmitting lines presents problems. The hose pipes are subjected to friction inside the boom. Furthermore, the c-shaped hose pipe bights are uncontrolled and may, for example, get into contact with the piston rod. This is particularly problematic, if the lines are hose pipes which are is pressurized jerkingly. Then the hose pipes may be deflected in uncontrolled manner.

U.S. Pat. No. 4,129,277 describes a carrier track for protecting flexible electrical conductors or fluid conduits in a rolling support.

U.S. Pat. No. 4,809,472 discloses a carrier track assembly for extensible and retractable boom machines, wherein the carrier track is not only wholly contained within the telescopic boom sections but also supported by the fluid cylinder during the extension and retraction of the boom sections.

DISCLOSURE OF THE INVENTION

It is the object of the invention to improve the arrangement and guiding of the energy transmission lines or hose pipes in an extensible machine part of the type mentioned in the beginning.

To this end, the energy transmission line extends inside the machine part and is provided at or in a carrier which can be bent in one direction through at least 180°. The actuators are arranged off-axis within the machine part. The carrier extends within the machine part in the space obtained by the off-axis arrangement of the actuator.

Thereby, the load on the energy transmission lines or hose pipes is reduced to a minimum. By guiding the energy transmission line or hose pipe inside the machine part, it will be protected from outside influences such as those due to weather. Furthermore, it cannot sag on the outside and thus also cannot be caught by objects. Because of the carrier, the energy transmission line is, to a large extent, protected from damages, for example due to friction, also inside the machine part. Because of the off-axis arrangement of the actuators, free space is provided for the carrier, whereby the guiding and movement of the energy transmission line and of the carrier is not impeded by the actuators. The energy transmission line or lines can be longitudinally movable in the carrier. Thereby changes of the length of the energy transmission line or hose pipe, which, for example, may occur, when a hydraulic hose pipe is exposed to pressure, can be admitted without causing stress on the lines or hose pipes. Then the energy transmission lines or hose pipes merely shift slightly in the carrier.

An embodiment of the invention is described in greater detail hereinbelow with reference to the accompanying drawings.

PREFERRED EMBODIMENT OF THE INVENTION

Figure 1:
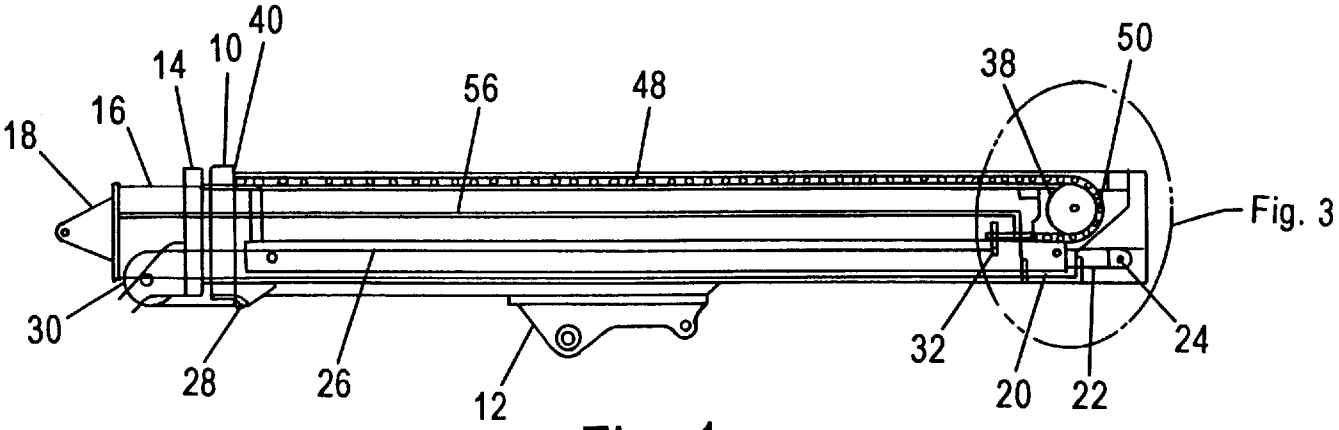
FIG. 1 is a schematic illustration and shows an embodiment of an extensible, telescopic machine part in its retracted state.

The embodiment illustrated in the Figures is a telescopic boom for cranes or excavators. Corresponding elements are designated by the same reference numeral in all Figures. The telescopic boom has three telescopic elements movable relative to each other. An outer telescopic element 10 is attached to a crane or excavator (not shown) by means of an attachment device 12. The outer telescopic element 10 is box-shaped of rectangular cross section and accommodates a median telescopic element 14 also of rectangular cross section. An inner telescopic element 16, also of substantially rectangular cross section is telescoped in the also box-shaped median telescopic element 14. An attachment device 18 for a working unit (not shown), for example a grab, is provided at the outer free end of the inner telescopic element 16. The mounting of the mutually displaceable telescopic elements 10, 14 and 16 on each other is effected in well-known way and, therefore, is not described in detail.

The median telescopic element 14 is displaced relative to the outer telescopic element 10 by a hydraulic jack. In the illustrated embodiment, the cylinder box 20 of the hydraulic jack is securely attached to the median telescopic element 14. The piston rod 22 of the hydraulic jack is connected to the outer telescopic element 10 at an attachment point 24. The piston rod 22 of the hydraulic jack extends within the cylinder box 20. As shown in the Figures, the cylinder box 20 with the hydraulic jack is arranged off-axis in the telescopic, mutually displaceable elements. The operation of such a hydraulic jack with cylinder box is knows per se and, therefore, is not described in detail.

The inner telescopic element 16 is displaceable relative to the median telescopic element 14 by means of a twofold cable actuator. Two cable arrangements extend parallel to each other and laterally offset with respect to the telescopic boom. A first cable 26 of each cable arrangement extends from a first attachment point 28 at the outer telescopic element 10 around a deflection roller 30 attached to the outer, in FIGS. 1 and 2, left end of the median telescopic element 14 to a second attachment point 32 at the inner telescopic element 16. A second cable 34 of each cable arrangement extends from a first attachment point 36 at the inner telescopic element 16 around a second deflection roller 38 attached to the inner, in FIGS. 1 and 2, right end of the median telescopic element 14 to a second attachment point at 40 (not shown in detail) at the outer telescopic element 10.

Figure 2:
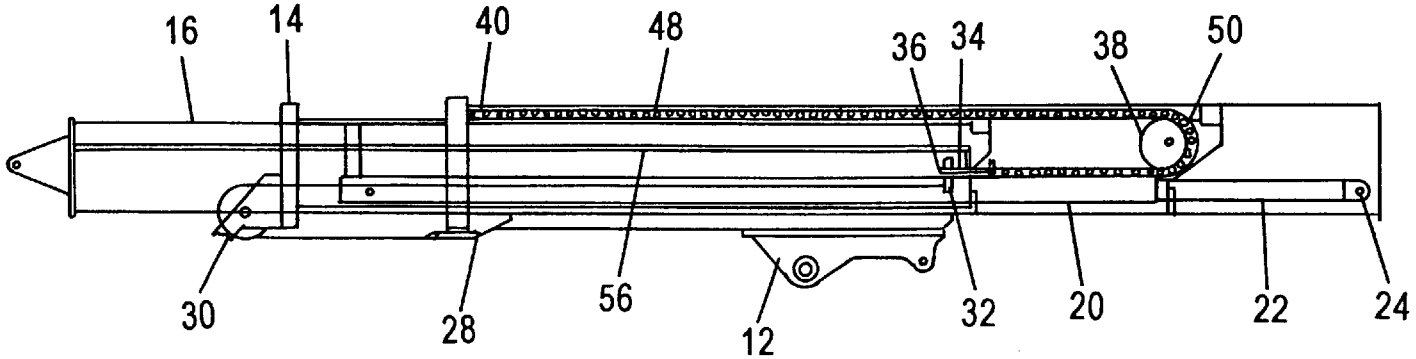
FIG. 2 is a schematic illustration and shows the machine part of FIG. 1 in a partly extended state.
Figure 3:
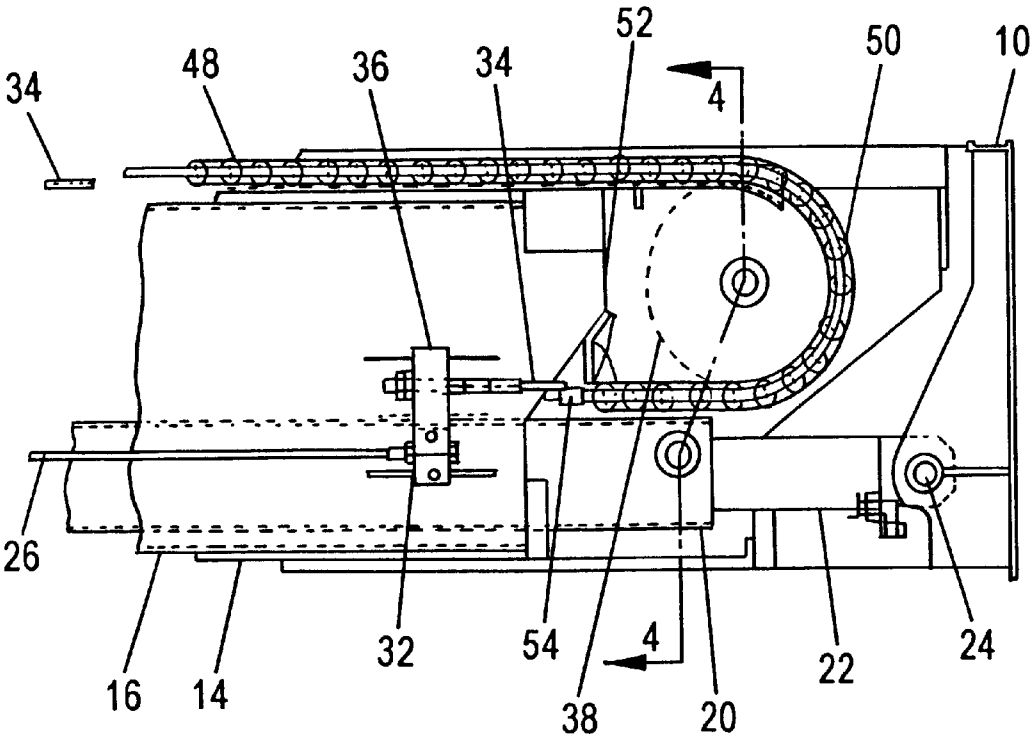
FIG. 3 is a schematic illustration and shows a partial view "A" of FIG. 1 at an enlarged scale.

Only parts of one of the cable arrangements are visible in FIGS. 1 to 3. Of the second cable arrangement, only the second deflection roller 42 is visible in FIG. 4.

If, starting from the retracted state of the telescopic boom as shown in FIG. 1, the median telescopic element 14 is pushed out of the outer telescopic element 10 by the hydraulic jack, then the inner telescopic element 16 is also pulled out of the median telescopic element 14 by the respective first cables 26. If the median telescopic element 14 is again retracted into the outer telescopic element 10 by the hydraulic jack, then also the inner telescopic element 16 ids also retracted into the median telescopic element 14 by the respective second cables 34. Thus the respective first cables 26 act as extending cables, and the respective second cables 34 act as retracting cables for the inner element 16.

In the illustrated embodiment, the working unit (not shown) attached to the attachment device 18 is operated hydraulically. The hydraulic pressure required therefor is supplied to the working unit through flexible hydraulic hose pipes from a hydraulic source (not shown) arranged outside the telescopic boom.

Figure 4:
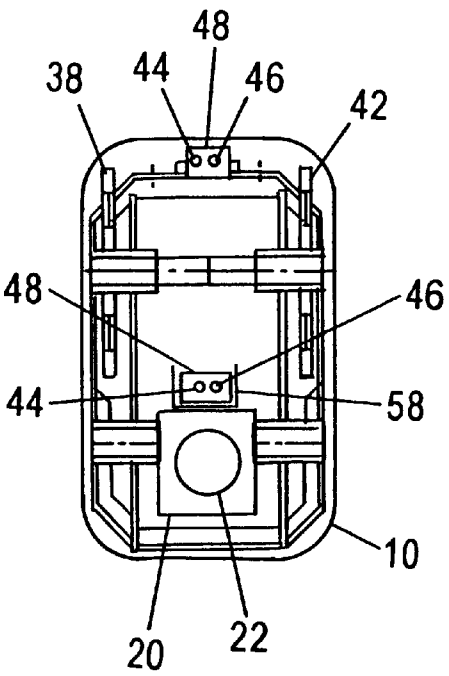
FIG. 4 is a schematic illustration and shows a sectional view of the machine part along the line B—B in FIG. 3.

The hydraulic pressure is, at first, conducted from the hydraulic source to the telescopic boom through hydraulic hose pipes (not shown) in well known way not described in detail. Connection ports for these hydraulic hose pipes can be located at 40 at the outer telescopic element 10. From these connection ports, the hydraulic pressure is conducted through hydraulic hose pipes in the interior of the telescopic boom. Two such hydraulic hose pipes 44 and 46 are shown in FIG. 4. The number of the hydraulic hose pipes depend on the nature of the working unit used.

In the interior of the telescopic boom, the hydraulic hose pipes 44 and 46 are guided in a carrier track 48. The carrier track is a chain the individual links of which are pivoted on each other about transverse axes only, whereby the chain can be bent in one longitudinal plane only. The carrier track 48 is affixed to the inner wall of the outer telescopic element 10 at 40. From this point, the carrier track 48 extends to the rear between the inner wall of the outer telescopic element 10 and the outer wall of the median telescopic element 14, i.e. to the right in FIGS. 1 to 3. Near the rear end of the median telescopic element 14, the right end in FIGS. 1 to 3, the carrier track 48 forms a c-shaped bight 50 and ends at the rear end of the inner telescopic element 16, the right end in FIGS. 1 to 3. There, the carrier track 48 is attached to the inner telescopic element 16 by an attachment device 52 (FIG. 3). Connection ports 54 for the hydraulic hose pipes 44 and 46 are provided at this end of the inner element 16. From these connection ports, the hydraulic pressure is conducted to the working unit by a hydraulic conduit 56 affixed to the inner telescopic element 16.

Because of the off-axis arrangement of the cylinder box 20 and of the hydraulic jack, there is sufficient space for accommodating the carrier track 48 forming the c-shaped bight 50, without the arrangement and movement of this carrier track being impeded by the hydraulic jack or other parts of the telescopic boom.

It is to be noted that no guiding elements for the c-shaped bight 50 are provided. The shape of the carrier track 48 results only from the attachment points and the guiding of the carrier track between the outer and the median telescopic elements 10 and 14, respectively.

When the telescopic boom is extended (FIG. 2), then the length of the carrier track 48 between the attachment point at the outer telescopic element 10 at 40 and the c-shaped bight 50 becomes shorter, and the length of the carrier track 483 between the c-shaped bight 50 and the attachment device 52 at the inner telescopic element 16 becomes correspondingly longer. Thus the c-shaped bight 50 follows the movements of the median element 14, the c-shaped bight 50 being formed by different links of the carrier track 48 depending on the position of the telescopic boom.

The guiding of the carrier track 48 between the c-shaped bight 50 and the attachment device 52 at the inner telescopic element 16 can be supported by guiding elements such as channel bars 58, in which the carrier track 48 is guided. These channel bars 56 can be attached to the cylinder box 20.

I claim:

1. An extensible, telescopic boom comprising an outer telescopic element of rectangular cross section having a first end, and second end, and an inner surface, a median telescopic element of rectangular cross section having a first end, a second end, and an outer surface and adapted for longitudinal movement in said outer telescopic element, a free space being formed between said inner surface of said outer telescopic element and said outer surface of said median telescopic element, an inner telescopic element of rectangular cross section having a first end, and a second end, and adapted for longitudinal movement in said median telescopic element, means for attaching an energy consuming working unit to said first end of said inner telescopic element, connecting means proximate said first end of said outer telescopic element for connection to a source of energy, first actuator means connected between said outer and median telescopic elements for respectively extending or retracting said median telescopic element out of or into said outer telescopic element at said first end thereof, said first actuator means being arranged off-axis within said telescopic elements, and second actuator means connected between said outer, said median and said inner telescopic elements for respectively extending or retracting said inner telescopic element out of or into said median telescopic element at said first end thereof, flexible transmission line carrier means having a first end and a second end, means for attaching said first end of said flexible transmission line carrier means to said inner surface of said outer telescopic element near said connecting means and said second end to said inner telescopic element through said second end thereof, said transmission line carrier means extending from said attaching means through said free space between said inner surface of said outer telescopic element and said outer surface of said median telescopic element and forming a bight around said second end of said inner telescopic element and sidewise of said off-axis first actuator means, energy transmission line means having a first end and a second end, said first end being connected to said connecting means and said second end being connected to said working unit attaching means for connection to a working unit attached thereto, said energy transmission line means being protectedly guided in said transmission line carrier means;

wherein said second actuator means comprise a pair of cable arrangements, each cable arrangement comprising a first cable, first and second deflection rollers, and a second cable; said first cable of each of said cable arrangements extending from a first attachment point at said outer telescopic element around said first deflection roller attached to said first end of said median telescopic element to a second attachment point at said inner telescopic element; said second cable of each of said cable arrangements extending from a first attachment point at said inner telescopic element around a second deflection roller attached to said second end of said median telescopic element to a second attachment point of said outer telescopic element.

2. An extensible, telescopic boom as in claim 1, wherein said energy transmission line means comprises a plurality of energy transmission lines.

3. An extensible, telescopic boom as in claim 1, wherein said energy transmission line means are hydraulic hose pipes.

4. An extensible, telescopic boom as in claim 1, wherein said transmission line carrier means comprises a carrier track.

5. An extensible, telescopic boom as in claim 1, and further comprising attachment means near said second end of said inner telescopic element for attaching said second end of said transmission line carrier means to said inner telescopic element, said attachment means comprising energy transmission line coupling means, said energy transmission line comprising flexible transmission lines protectedly guided in said transmission line carrier means and conduit means affixed to said inner telescopic element, said conduit means having a first end and a second end, said first end being coupled through said energy transmission line coupling means with said flexible transmission lines, said second end of said conduit means being said second end of said energy transmission line means connected to said working unit attaching means.

6. An extensible, telescopic boom as in claim 1, wherein said pair of cable arrangements are laterally offset and arranged on both sides of said transmission line carrier means.

7. An extensible, telescopic boom as in claim 1, wherein the energy transmission line means are longitudinally movable in the carrier.

8. An extensible, telescopic boom comprising an outer telescopic element having a first end, a second end, and an inner surface, an inner telescopic element having a first end, a second end, an outer surface, and adapted for longitudinal movement in said outer telescopic element, a free space being formed between said inner surface of said outer telescopic element and said outer surface of said inner telescopic element, means for attaching an energy consuming working unit to said first end of said inner telescopic element, connecting means proximate said first end of said outer telescopic element for connection to a source of energy, actuator means connected between said outer and inner telescopic elements for respectively extending or retracting said inner telescopic element out of or into said outer telescopic element at said first end thereof, said actuator means being arranged off-axis within said telescopic elements, flexible transmission line carrier means having a first end and a second end, means for attaching said first end of said flexible transmission line carrier means to said inner surface of said outer telescopic element near said connecting means and said second end to said inner telescopic element through said second end thereof, said transmission line carrier means extending from said attaching means through said free space between said inner surface of said outer telescopic element and said outer surface of said inner telescopic element and forming a bight around said second end of said inner telescopic element and sidewise of said off-axis actuator means, energy transmission line means having a first end and a second end, said first end being connected to said connecting means and said second end being connected to said working unit attaching means for connection to a working unit attached thereto, said energy transmission line means being protectedly guided in said transmission line carrier means.

* * * * *